US007117995B2

(12) United States Patent
Connard, III

(10) Patent No.: US 7,117,995 B2
(45) Date of Patent: Oct. 10, 2006

(54) CONCRETE RECLAMATION APPARATUS

(76) Inventor: Leslie R. Connard, III, 1156 Steffen St., Glendora, CA (US) 91741

( * ) Notice: Subject to any disclaimer, the term of this patent is extended or adjusted under 35 U.S.C. 154(b) by 356 days.

(21) Appl. No.: 10/756,215

(22) Filed: Jan. 12, 2004

(65) Prior Publication Data

US 2004/0159595 A1 Aug. 19, 2004

Related U.S. Application Data

(63) Continuation-in-part of application No. 10/269,721, filed on Oct. 11, 2002, now abandoned.

(51) Int. Cl.
*B07B 1/04* (2006.01)

(52) U.S. Cl. ..... 209/421; 209/420; 209/355; 209/353

(58) Field of Classification Search ..... 209/475, 209/678, 680, 706, 421, 931
See application file for complete search history.

(56) References Cited

U.S. PATENT DOCUMENTS

| | | | | |
|---|---|---|---|---|
| 2,919,808 | A * | 1/1960 | Hilkemeier | 210/523 |
| 3,997,434 | A * | 12/1976 | Macauley, Jr. | 209/10 |
| 4,016,978 | A * | 4/1977 | Danna, Jr. | 209/2 |
| 4,192,745 | A * | 3/1980 | Hood | 106/713 |
| 4,285,808 | A * | 8/1981 | Horton | 209/17 |
| 5,127,740 | A * | 7/1992 | DeBoer | 366/2 |
| 5,244,498 | A * | 9/1993 | Steinke | 106/819 |
| 5,268,111 | A * | 12/1993 | Metz et al. | 210/712 |
| 5,312,051 | A * | 5/1994 | Preisser | 241/1 |
| 5,481,092 | A * | 1/1996 | Westmeyer | 219/679 |
| 5,524,769 | A * | 6/1996 | Spencer | 209/270 |
| 5,685,978 | A * | 11/1997 | Petrick et al. | 210/241 |
| 5,741,065 | A | 4/1998 | Bell et al. | |
| 5,778,910 | A * | 7/1998 | Brenner | 134/65 |
| 6,000,645 | A * | 12/1999 | Preisser | 241/41 |
| 6,089,795 | A * | 7/2000 | Booth | 406/43 |
| 6,155,277 | A | 12/2000 | Barry | |
| 6,325,311 | B1 * | 12/2001 | Preisser | 241/74 |
| 6,354,439 | B1 | 3/2002 | Arbor | |
| 6,461,098 | B1 * | 10/2002 | Elefsrud | 414/618 |
| 6,491,070 | B1 * | 12/2002 | Espina Frutos | 141/93 |
| 6,640,817 | B1 * | 11/2003 | Harmon | 134/22.18 |
| 6,758,590 | B1 * | 7/2004 | Black | 366/64 |
| 6,782,925 | B1 * | 8/2004 | Raposo et al. | 141/5 |
| 6,783,007 | B1 * | 8/2004 | Arbore | 209/421 |
| 6,871,658 | B1 * | 3/2005 | Gjestvang | 134/167 R |
| 6,929,395 | B1 * | 8/2005 | Metz | 1/1 |
| 6,966,687 | B1 * | 11/2005 | Elefsrud | 366/26 |
| 2002/0092798 | A1 * | 7/2002 | Dehart et al. | 209/17 |
| 2002/0092799 | A1 * | 7/2002 | Storruste | 209/460 |
| 2006/0000490 | A1 * | 1/2006 | Barragan et al. | 134/10 |

FOREIGN PATENT DOCUMENTS

| | | | |
|---|---|---|---|
| CA | 2330511 | A1 * | 6/2002 |
| JP | 401307461 | A * | 12/1989 |

* cited by examiner

*Primary Examiner*—Kathy Matecki
*Assistant Examiner*—Jonathan R Miller
(74) *Attorney, Agent, or Firm*—Denton L. Anderson; Sheldon & Mak PC

(57) ABSTRACT

An apparatus which is useful in the separation of solids from a diluted, wet, concrete mixture has (a) a free-standing first container with a drain port and a top opening, (b) a strainer disposed within the first container, (c) a drain port shut-off valve, (d) a second container capable of providing a reservoir for recovered liquid, and (e) a transfer conduit for allowing effluent from the drain port of the first container to gravitate into the second container.

6 Claims, 7 Drawing Sheets

CONCRETE RECLAMATION APPARATUS

RELATED APPLICATIONS

This application is a continuation-in-part of U.S. patent application Ser. No. 10/269,721, filed Oct. 11, 2002 now abandoned and entitled "Environmentally Safe Concrete Reclamation Tool," the entirety of which is incorporated herein by this reference.

FIELD OF THE INVENTION

This invention relates generally to concrete reclamation apparatuses and, more specifically, to vehicle-mounted concrete reclamation apparatuses.

BACKGROUND OF THE INVENTION

Concrete is a substance which is an amalgam of various materials, usually water, sand, gravel, cement, fiberglass, chemicals and other additives depending upon the concrete processing plant's abilities and the end user's desires. Concrete is commonly transported to a construction site in concrete mixture delivery vehicles, typically large trucks. The concrete within the delivery vehicles is typically prepared and retained within a large rotatable mixing drum. During transportation within the mixing drum, the concrete is in a wet, relatively fluid state. At the construction site, the wet concrete mixture is typically gravitated from the delivery vehicle via one or more pour chutes.

After substantially all of the concrete mixture is unloaded from the delivery vehicle, a considerable amount of wet concrete mixture continues to adhere to the pour chutes. In the past, this remaining wet concrete mixture was merely hosed off onto the ground. Today, however, the rinse water used to clean the pour chutes is considered a potential groundwater contaminant. Consequently, environmental laws generally prohibit the disbursal of such rinse waters onto the ground. All such rinse waters must be recouped and recycled without being allowed to flow into streets, storm drains or gutters or allowed to percolate into the soil.

One way of dealing with concrete mixture rinse waters at large construction sites is to deposit such rinse waters in a prefabricated lined evaporation pit. The construction of a prefabricated evaporation pit at smaller commercial and residential construction sites is not practical, however.

U.S. Pat. Nos. 5,741,065, 6,155,277 and 6,354,439 disclose a variety of equipment for allowing the removal of concrete chute rinse water in the delivery vehicle. However, each such proposed equipment requires the use of expensive and bulky hydraulic, pneumatic or electrical components which must be carried on the delivery vehicle. Such hydraulic or electrical components are expensive to purchase and maintain and awkward to carry on the delivery vehicle. Also, such hydraulic, pneumatic or electrical components leave the driver of the delivery vehicle vulnerable to hydraulic, pneumatic and electrical system failures which would prevent use of the equipment at the construction site. Still further, proposed equipment in the prior art frequently suffer from leakage of contaminated water during the disconnecting of hoses from collection vessels. Finally, several of the proposed equipment requires the use of the vehicle's mixing drum to store the recovered rinse water. Storing such rinse water in the mixing drum can adversely affect the integrity of the next load of concrete mixture prepared and transported within the mixing drum, unless the rinse water is thoroughly drained from the mixing drum prior to the preparation of the next batch of concrete mixture. From a practical standpoint, this is a major disadvantage of such proposed equipment because there is a strong temptation among individual concrete mixture preparation personnel to reuse the rinse water (already in the mixing drum) rather than to take the time to thoroughly drain and reconstitute the rinse water and to replace it in the mixing drum with fresh water.

Accordingly, there is a need for a concrete reclamation apparatus which avoids the aforementioned problems in the prior art in an efficient and inexpensive manner.

SUMMARY OF THE INVENTION

The invention satisfies this need. The invention is an apparatus useful in the separation of solids from a diluted, wet concrete mixture. The apparatus is suitable for use on a concrete mixture delivery vehicle. The apparatus comprises (a) a free standing first container having an internal volume of at least about one half gallon, the first container having a drain port and a top opening; (b) a strainer disposed within the first container so as to bifurcate the internal volume of the first container into a first portion and a second portion, the second portion including the drain port of the first container, the strainer having a plurality of apertures; (c) a drain port shut-off valve for alternatively opening and closing the drain port of the first container; (d) one or more connectors for attaching the first container to the pour chute of a concrete mixture delivery vehicle; (e) a second container separate from the mixing drum of the concrete mixture delivery vehicle, the second container having an internal volume of at least about 5 gallons, the second container being attached to the concrete mixture delivery vehicle and having an inlet port and a drain port; and (f) a transfer conduit for connecting the drain port of the first container in fluid tight communication with the inlet port of the second container, so that liquid within the second portion of the first container can be gravitated to the second container.

DESCRIPTION OF THE DRAWINGS

These and other features, aspects and advantages of the present invention will become better understood with reference to the following description, appended claims and accompanying drawings where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 1:
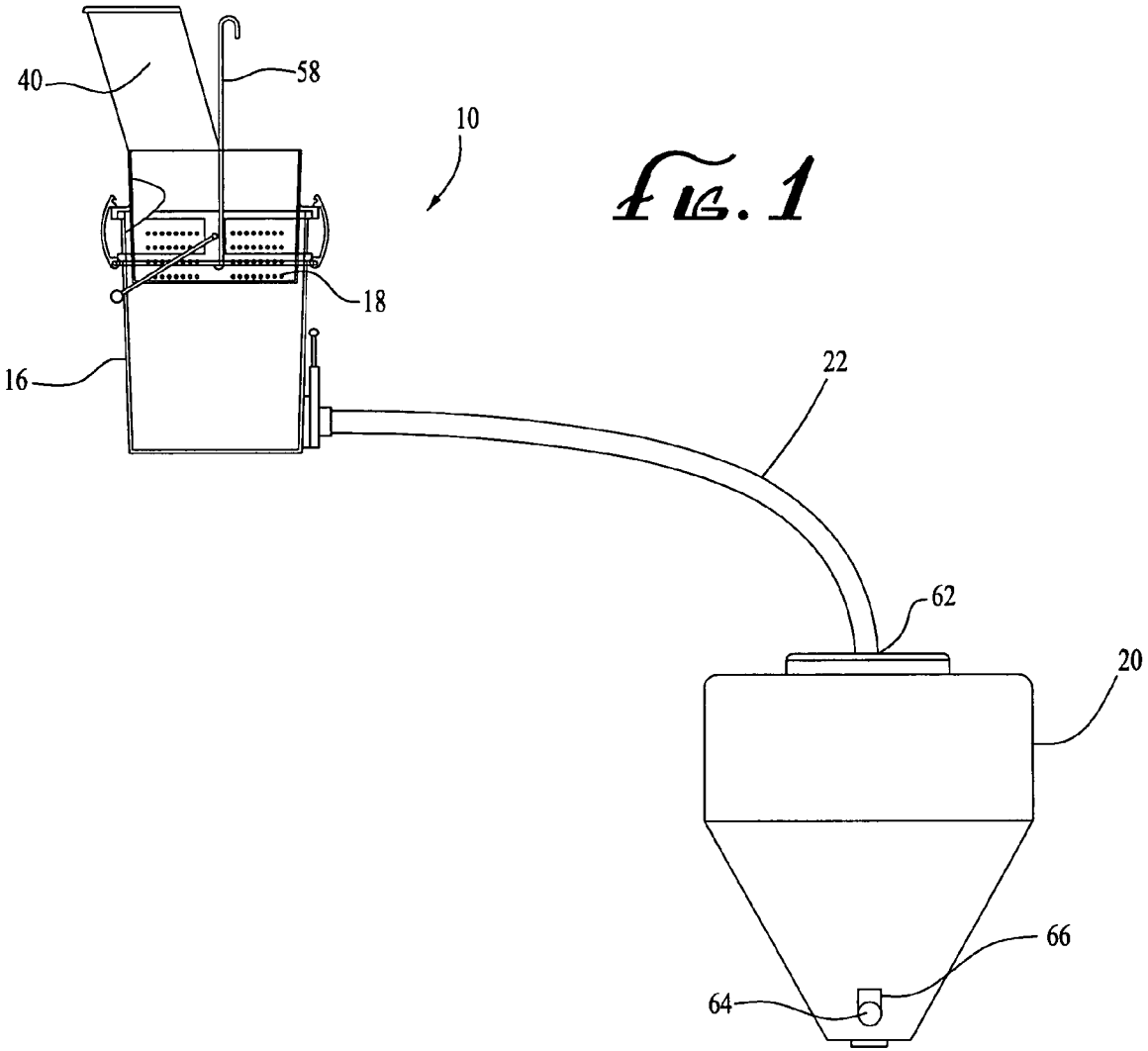
FIG. 1 is diagrammatic side view of an apparatus having features of the invention.

The invention is an apparatus 10 useful in the separation of solids from a diluted, wet concrete mixture, such as from the dilute wet concrete mixtures carried within the mixing drum 12 of a concrete mixture delivery vehicle 14. The apparatus 10 is illustrated in FIG. 1. The apparatus 10 comprises a first container 16, a strainer 18, a second container 20 and a transfer conduit 22 connecting the first container 16 and the second container 20.

The first container 16 is a free standing vessel having an internal volume of at least about one half gallon. Typically, the volume of the first container 16 is between about 5 gallons and about 20 gallons. The first container 16 has a drain port 24 and a top opening 26. The top opening 26 is sized and dimensioned to cooperate with the end of a concrete mix delivery vehicle pour chute 28. Typically, the top opening 26 of the first container 16 has a width between about 10 inches and about 20 inches and a depth typically between about 4 inches and about 20 inches.

The first container 16 is typically made from a lightweight material, such as a lightweight plastic, reenforced plastic, composite material or lightweight metal. First containers 16 made from ethylpropylene or aluminum are readily useable in the invention. Preferably, the first container 16 weighs less than about 20 pounds. Typically, the first container 16 weighs between about 5 pounds and about 15 pounds.

Disposed within the first container 16 is the strainer 18 which effectively bifurcates the internal volume of the first container 16 into a first portion and a second portion. The second portion 32 of the first container 16 includes the drain port 24 of the first container 16. The strainer 18 has a plurality of apertures 34. Typically, the plurality of apertures 34 are round holes having diameters between about ¼ inch and about ⅜ inch.

Figure 2:
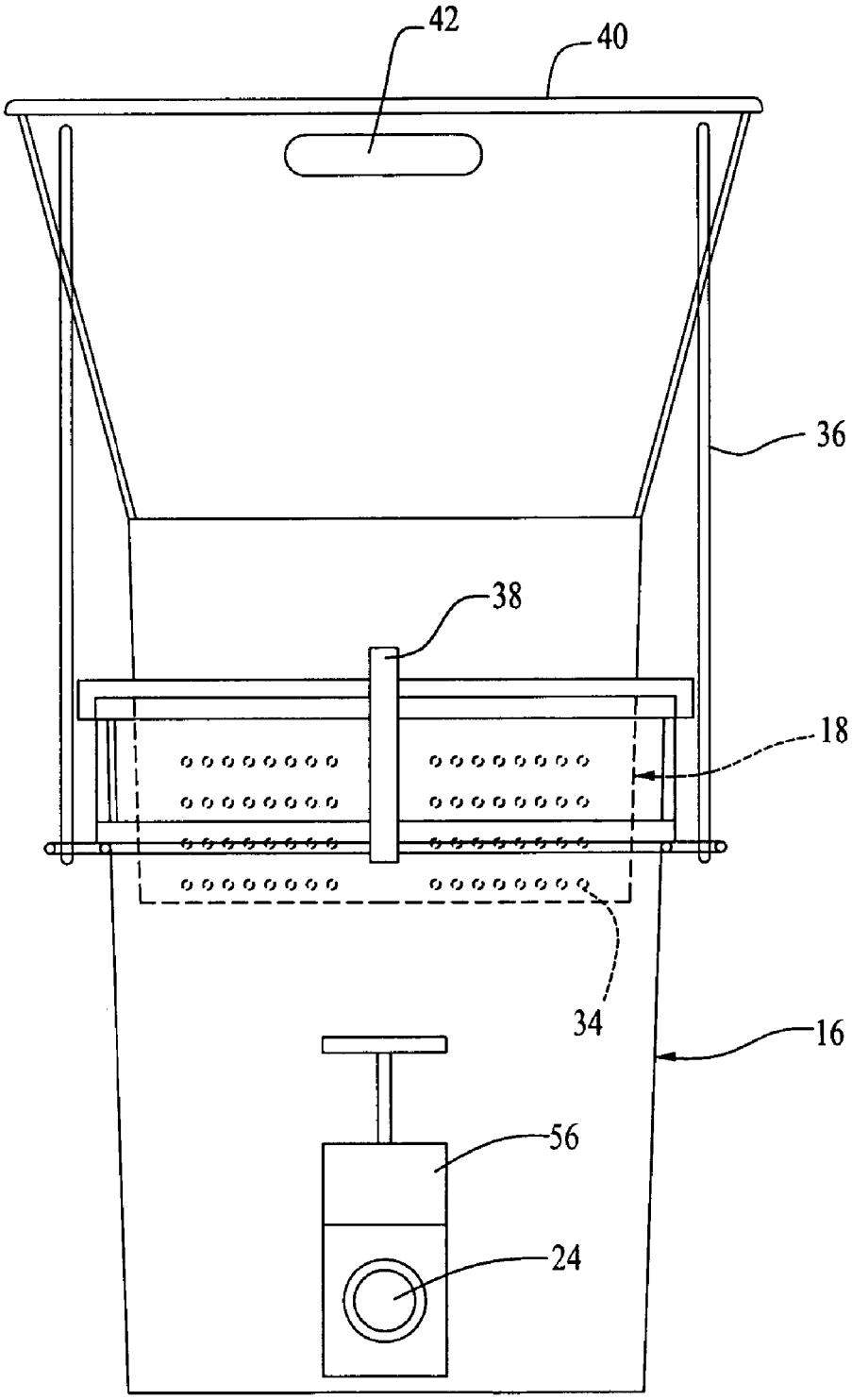
FIG. 2 is a front view of a first embodiment of a container and strainer assembly useable in the invention.
Figure 3:
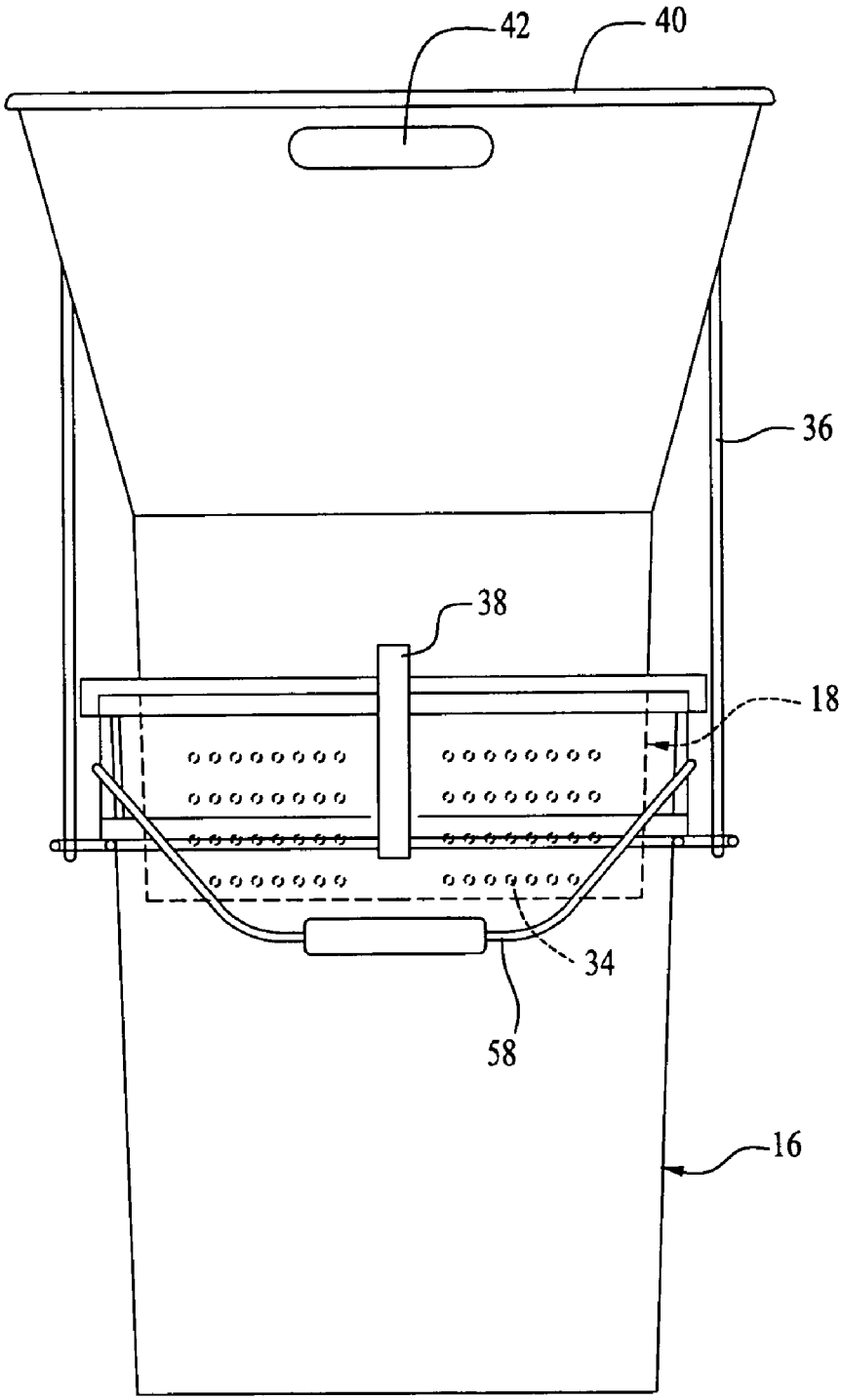
FIG. 3 is a rear view of the container and strainer assembly illustrated in FIG. 2.
Figure 4:
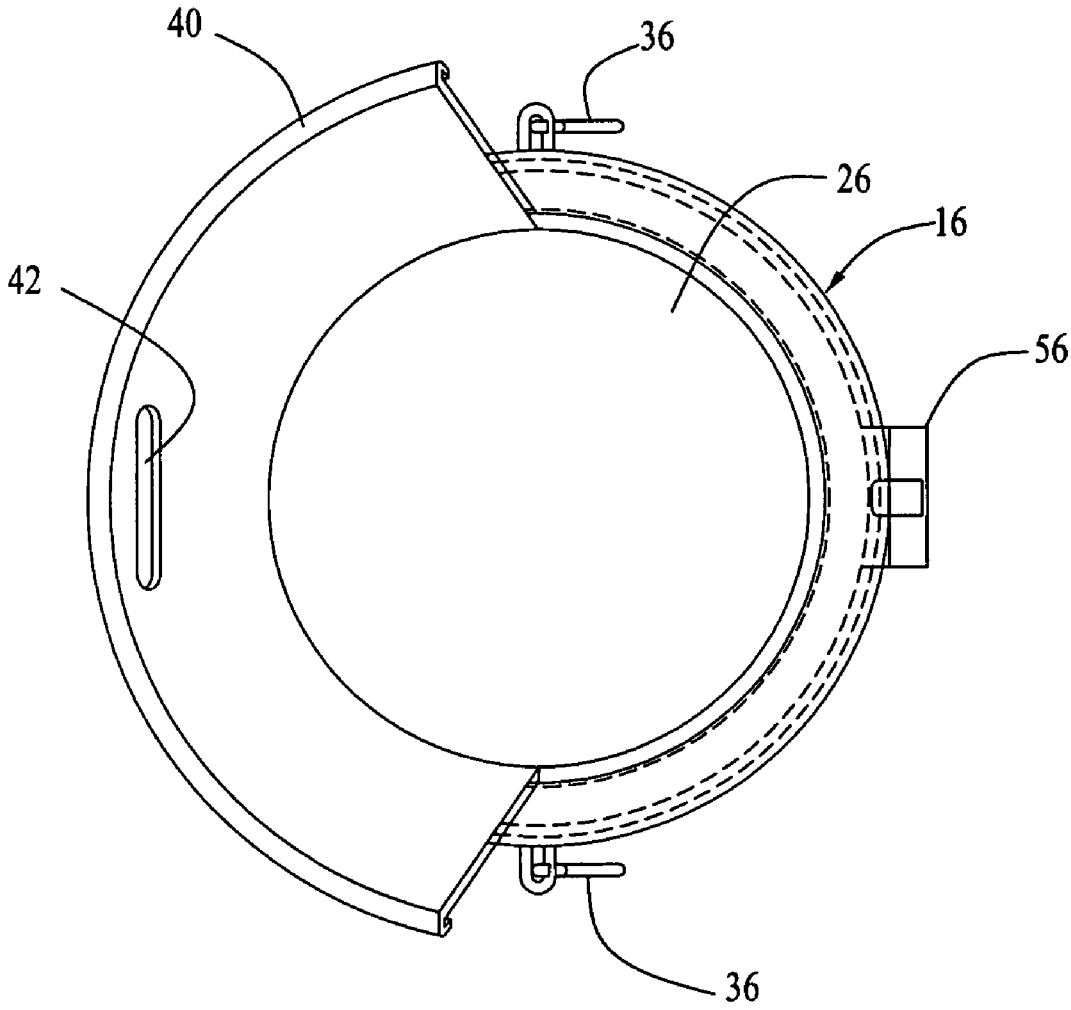
FIG. 4 is a top view of the container and strainer combination illustrated in FIG. 2.
Figure 5:
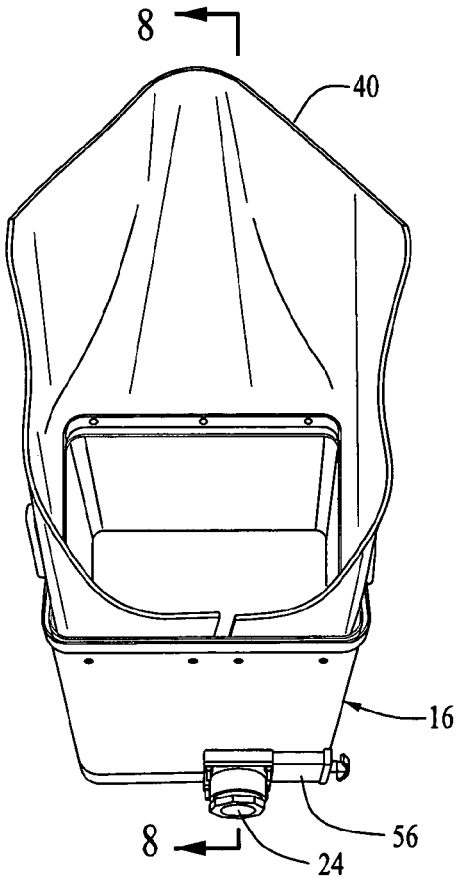
FIG. 5 is a perspective view of a second embodiment of a container and strainer assembly useable in the invention, showing a splash guard in a fully extended position.
Figure 6:
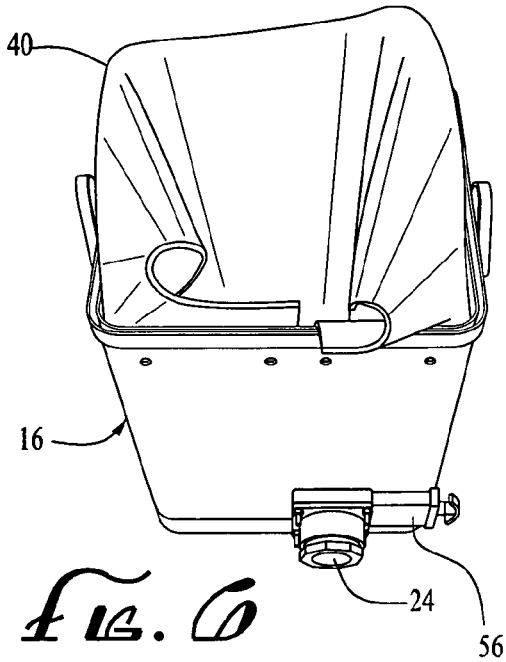
FIG. 6 is a perspective view of the container and strainer assembly illustrated in FIG. 5 showing the splash guard in a folded position.
Figure 7:
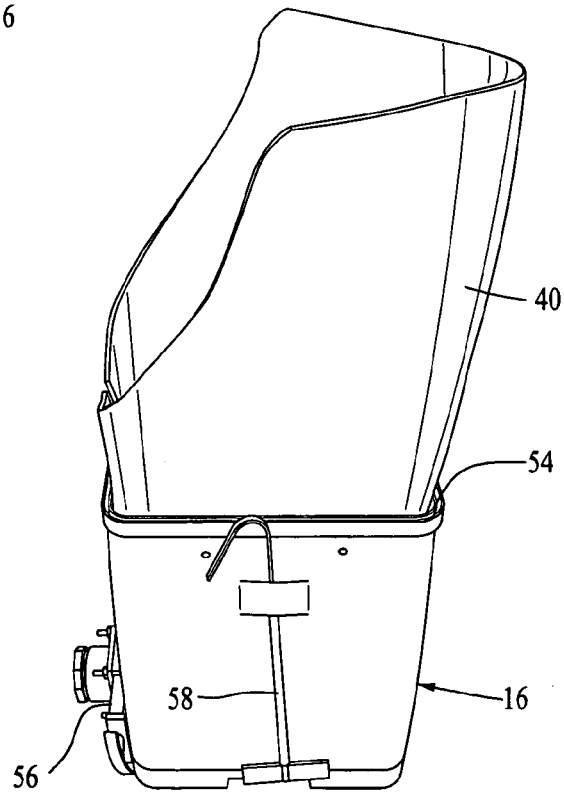
FIG. 7 is a perspective view of the container and strainer assembly illustrated in FIG. 5, shown from one side of the assembly.
Figure 8:
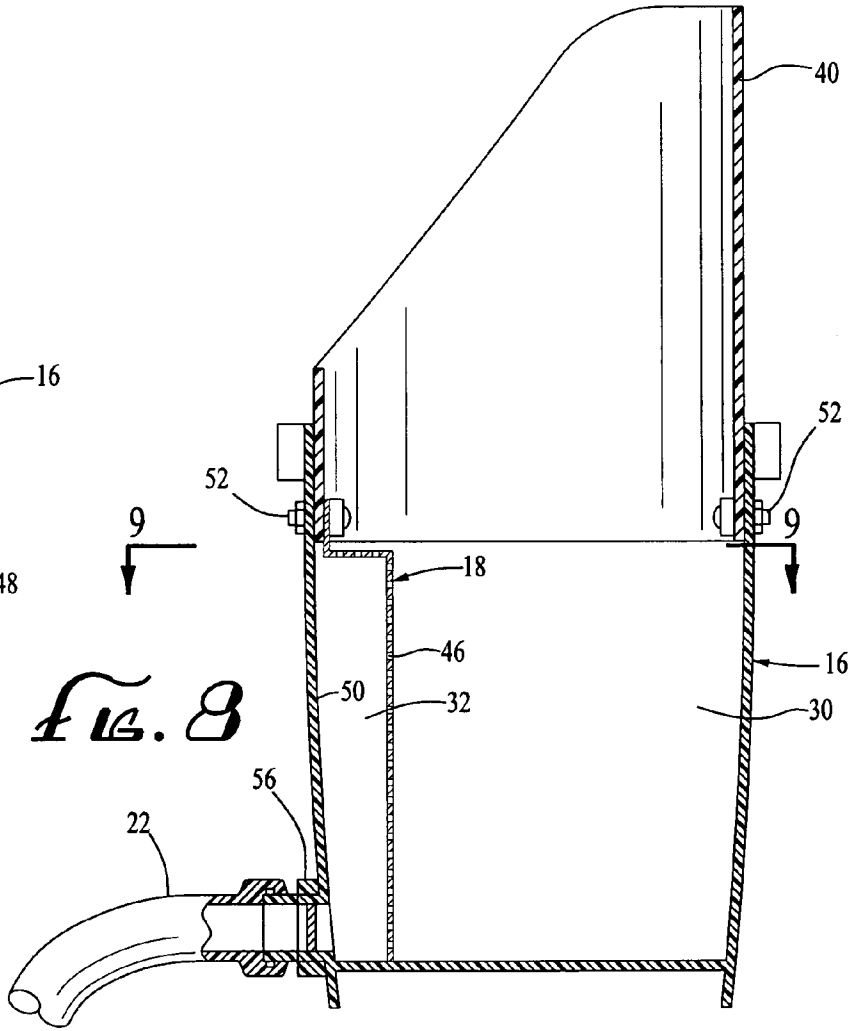
FIG. 8 is a cross-sectional view of the container and strainer assembly illustrated in FIG. 7.
Figure 9:
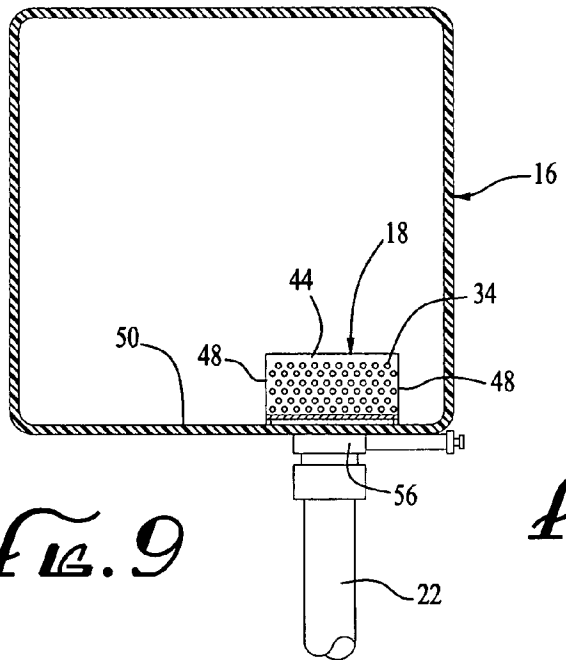
FIG. 9 is a cross-sectional top view of the container and strainer assembly illustrated in FIG. 8, taken along line 9—9.

FIGS. 2–4 illustrate one embodiment of a first container 16 having a strainer 18 disposed therein. In this embodiment, the strainer 18 is a basket structure having side walls and a perforated bottom portion. The strainer 18 nests into the upper portion of the first container 16, and is retained to the first container 16 by appropriate struts 36 and clamps 38.

A splash guard 40 is appended to the upper portion of the strainer 18. The splash guard 40 has a handle opening 42 to facilitate the removal of the strainer 18 from the first container 16.

FIGS. 5–9 illustrate a second embodiment of a first container 16 having the strainer 18 therein. In the embodiment illustrated in FIGS. 5–9, the strainer 18 is an elongate three-dimensional vertical structure having a perforated top wall 44, a perforated front wall 46 and side wings 48. The strainer 18 sits on the bottom of the first container 16 with the side wings 48 disposed in abutment with one of the side walls 50 of the first container 16. In one example of this embodiment, the strainer 18 is about 12 inches high and has a folded one-inch flange that extends above the strainer 18 to facilitate the attachment of the strainer 18 to the side wall 50 of the first container 16. The sides of the strainer 18 are about 2½ inches wide and 12 inches tall. The top wall of the strainer 18 is 2½ inches wide and 5 inches long. In this embodiment, the strainer 18 is affixed to one of the side walls 50 of the first container 16 by one or more attachment bolts 52. Rivots or other suitable attachment means can also be used.

In the embodiment illustrated in FIGS. 5–9, the splash guard 40 is made from a resilient, flexible material, such as a rubber, fiber reenforced rubber or suitable soft pliable plastic material. Where the splash guard 40 is made from a fiber reenforced rubber, the thickness of the splash guard 40 is typically on the order of ¼ inch–⅜ inch. Preferably, the splash guard 40 extends above the rear edge 54 of the first container 16 by a distance of at least about 4 inches. Typically, the splash guard 40 extends above the rear edge 54 of the first container 16 by a distance of between about 10 inches and about 18 inches. The splash guard 40 is physically attached to the upper portion of the first container 16 by attachment bolts 52.

Because the splash guard 40 in the embodiments illustrated in FIGS. 5–9 is flexible, the splash guard 40 can be conveniently folded into the first container 16 for easy storage and transportation when not in use.

In all embodiments, the first container 16 further comprises a first container drain port shut-off valve 56 for alternatively opening and closing the drain port 24 of the first container 16. Typically, the first container drain port shut-off valve 56 is a simple slide valve as illustrated in the drawings.

Also in all embodiments, the first container 16 further comprises one or more connectors 58 for attaching the first container 16 to the pour chute 28 of a concrete mixture delivery vehicle 14. In the embodiment illustrated in FIGS. 2–4, the one or more connectors 58 are provided by a handle. In the embodiments illustrated in FIGS. 5–9, the one or more connectors 58 are provided by a pair of retractable hooks.

The second container 20 is separate from the first container 16 and from the mixing drum 12 of the concrete mixture delivery vehicle 14. The second container 20 has an internal volume of at least about 5 gallons. Typically, the internal volume of the second container 20 is between about 20 gallons and about 50 gallons. The second container 20 comprises an inlet port 62 and a drain port 64. Preferably, flow from the drain port 64 is controlled by a second container drain port shut-off valve 66.

Typically, the second container 20 is made from a lightweight material, such as those useable in the manufacture of the first container 16. The second container 20 can also be made of heavier materials, such as stainless steels. The second container 20 is attached to the concrete mixture delivery vehicle 14, such that the inlet port is no higher than about 6 feet off of the surface 68 upon which the concrete mixture delivery vehicle 14 is disposed. Typically, the height of the inlet port 62 of the second container 20 above such a surface 66 is between about 2 feet and about 6 feet.

The assembly further comprises a transfer conduit 22 for connecting the drain port 24 of the first container 16 in fluid tight communication with the inlet port 62 of the second container 20. This allows liquid within the second portion 32 of the first container 16 to be gravitated to the second container 20. Typically, the transfer conduit 22 is a flexible hose having suitable snap-on connections which cooperate with corresponding connections at the drain port 24 of the first container 16 and the inlet port 62 of the second container 20.

Figure 10:
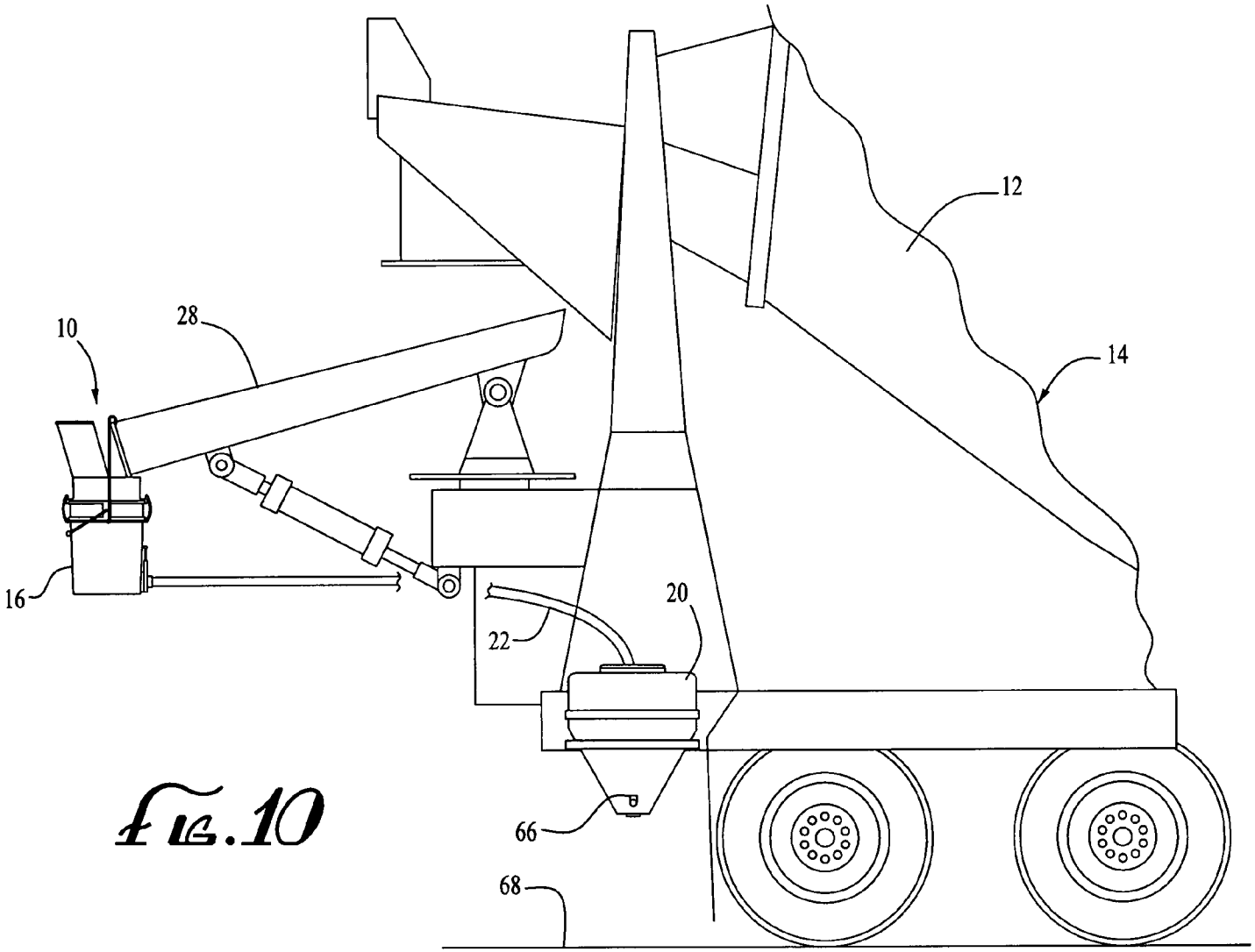
FIG. 10 is a side view of an apparatus having features of the invention, shown in use with a concrete mixture delivery vehicle.

In operation, as illustrated in FIG. 10, the first container 16, having the strainer 18 disposed therein, is attached to the end of a pour chute 28 of a concrete mixture delivery vehicle 14 using the one or more connectors 58. The transfer conduit 22 is attached to both the drain port 24 of the first container 16 and the inlet port 62 of the second container 20.

The pour chute 28 of the concrete mixture delivery vehicle 14 is then hosed off with a carefully directed stream of water. All of the water and the residual concrete mix adhering to the pour chute 28 is swept into the first container 16. As this is accomplished, the splash guard 40 acts to prevent the inadvertent splashing of liquid and concrete materials onto the ground.

Within the first container 16, the diluted, wet concrete mixture is separated into a solids component and a liquid component by the strainer 18. The solids component is retained within the first portion 30 of the first container 16, while the liquid component percolates through the apertures in the strainer 18 to the second portion 32 of the first container 16.

Thereafter, the first container 16 is elevated by raising the pour chute 28 until the drain port 24 of the first container 16 is higher in elevation than the inlet port 62 of the second container 20. At this point, the first container drain port shut-off valve 56 is opened and the liquid effluent within the second portion 32 of the first container 16 is allowed to gravitate from the first container 16 to the second container 20.

After the liquid effluent within the second portion 32 of the first container 16 is gravitated to the second container 20, the first container drain port shut-off valve 56 is closed to prevent any spillage from the first container 16. The transfer of conduit 22 is then safely disconnected from the first container 16 and the second container 20.

Thereafter, the solids within the first portion 30 of the first container 16 can be conveniently poured onto a sheet of plastic where it can be left to dry and harden in the sun. The liquid effluent within the second container 20 is safely retained in the second container 20 until the delivery vehicle 14 is returned to the manufacturing plant. There, the liquid effluent can be readily drained to a suitable effluent reclamation system via the drain port 64 in the second container 20.

The invention provides for a simple and efficient method of dealing with waste concrete mix residue without the need of expensive, bulky and difficult to maintain electrical and/or hydraulic components. The incorporation of a shut-off valve on the drain port of the first container also eliminates problems of spillage after the transfer conduit is disconnected from the first container.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. An apparatus useful in the separation of solids from a diluted, wet concrete mixture within the mixing drum of a concrete mixture delivery vehicle, the apparatus comprising:

(a) a free standing first container having an internal volume of at least about one half gallon, the first container having a drain port and a top opening;

(b) a strainer disposed within the first container so as to bifurcate the internal volume of the first container into a first portion and a second portion, the second portion including the drain port of the first container, the strainer having a plurality of apertures;

(c) a first container drain port shut-off valve for alternatively opening and closing the drain port of the first container;

(d) one or more connectors for attaching the first container to the pour chute of a concrete mixture delivery vehicle;

(e) a second container separate from the mixing drum of the concrete mixture delivery vehicle, the second container having an internal volume of at least about 5 gallons, the second container being attached to the concrete mixture delivery vehicle and having an inlet port and a drain port; and (f) a transfer conduit for connecting the drain port of the first container in fluid tight communication with the inlet port of the second container, so that liquid within the second portion of the first container can be gravitated to the second container.

2. The apparatus of claim 1 wherein the inlet port of the second container is disposed less than about 6 feet above a horizontal surface upon which the concrete mix delivery vehicle is disposed.

3. The apparatus of claim 1 further comprising a splash guard disposed around the top opening of the first container, the splash guard being foldable into the first container when the first container is not in use.

4. The apparatus of claim 1 wherein the first container comprises a side wall and wherein the strainer is an elongate three-dimensional vertical structure having a perforated top wall, a perforated front wall and side wings, the side wings being disposed in abutment with the side wall of the first container so as to define an enclosed volume adjacent to the side wall which provides the second portion of the first container.

5. The apparatus of claim 1 wherein the strainer is a basket structure which can be readily lifted out of the first container.

6. The apparatus of claim 1 wherein the second container further comprises a second container drain port shut-off valve for alternatively opening and closing the drain port of the second container.

* * * * *